US006605165B2

(12) United States Patent
Kunishi et al.

(10) Patent No.: US 6,605,165 B2
(45) **Date of Patent: *Aug. 12, 2003**

(54) METHOD OF MANUFACTURING DISCHARGE WIRE

(75) Inventors: Tsuyoshi Kunishi, Moriya-machi (JP); Nobuhiro Hayashi, Tokyo (JP); Toru Kabashima, Toride (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/578,911

(22) Filed: May 26, 2000

(65) Prior Publication Data

US 2003/0129426 A1 Jul. 10, 2003

(30) Foreign Application Priority Data

May 28, 1999 (JP) ..... 11-150168

(51) Int. Cl.[7] ..... C22F 1/18
(52) U.S. Cl. ..... 148/537; 148/668; 148/673
(58) Field of Search ..... 428/469, 472, 428/472.1, 336; 148/516, 537, 559, 668, 673

(56) References Cited

U.S. PATENT DOCUMENTS 3,764,866 A * 10/1973 Bonaventura et al. .. 317/262 A

FOREIGN PATENT DOCUMENTS

| | | | |
|---|---|---|---|
| EP | 1055972 A2 | * | 11/2000 |
| JP | 48-74231 | | 10/1973 |
| JP | 358029522 A | * | 2/1983 |
| JP | 61-006263 | * | 1/1986 |
| JP | 61135445 A | * | 6/1986 |
| JP | 61-139673 | * | 6/1986 |
| JP | 62-222097 | * | 9/1987 |
| JP | 40249086 A | * | 9/1996 |
| JP | 8-305135 | | 11/1996 |
| JP | 2675837 | | 11/1997 |

* cited by examiner

*Primary Examiner*—Deborah Jones
*Assistant Examiner*—Stephen Stein
(74) *Attorney, Agent, or Firm*—Fitzpatrick, Cella, Harper & Scinto

(57) ABSTRACT

A discharge wire usable in an electrification device includes a tungsten wire subjected to mirror finish processing and an oxidized layer formed by heating the surface of the tungsten wire at a temperature in the range 400 to 600° C., wherein the film has a thickness in the range of 0.01 to 0.3 $\mu$m.

6 Claims, 5 Drawing Sheets

METHOD OF MANUFACTURING DISCHARGE WIRE

BACKGROUND OF THE INVENTION

1. Field of the Invention

The present invention relates to a corona electrifying type electrification device which, is mainly used in an image forming apparatus, such as a copy machine, a printer and the like, and to a discharge wire used in the electrification device and to a method of manufacturing the discharge wire.

2. Description of the Related Art

Conventionally, electrification devices making use of a corona discharge phenomenon are widely used in image forming apparatuses, such as electrophotographic type copy machines, laser beam printers, and the like. Typical examples of such apparatuses are, for example, a primary electrification device for uniformly charging the surface of an image carrier on which an electrostatic latent image is to be formed, a transfer electrification device for transferring a toner image formed on the surface of the image carrier onto a member to be transferred, and the like.

FIG. 6 shows an example of a conventional electrification device. This type of the electrification device comprises a discharge wire 101 having a diameter of about 50 to 200 $\mu$m, an image carrier, a shield plate 102 as a confronting electrode disposed so as to surround the discharge wire with a portion thereof facing a member to be charged such as a member to be transferred, electrification blocks 103*a* and 103*b* in which the discharge wire 101 is stretched, and a high voltage power supply (not shown) for imposing a voltage capable of causing corona discharge from the discharge wire 101.

However, this type of corona type electrification device has a problem that when the discharge wire discharges, corona air currents are generated, and the discharge wire collects dust and the like contained in the air in the periphery of the electrification device and is polluted thereby.

In particular, in an image forming apparatus using an electrophotographic system, the discharge wires of a primary electrification device, a transfer electrification device and a separation electrification device collect toner floating in the peripheries of the discharge wires and are liable to be polluted. Moreover, the pollutants deposited on the discharge wires are baked on surfaces thereof by the discharge of the discharge wires and very strongly adhered thereon.

On the other hand, the primary electrification device, the transfer electrification device, the separation electrification device, and the like used in the image forming apparatus must uniformly discharge in the direction in which the discharge wires are stretched. However, it cannot be expected that the discharge wires polluted with toner and the like uniformly discharge, and, as a result, there is a problem that a good image cannot be obtained unless the discharge wires are frequently cleaned or replaced.

Specifically, if the primary electrification device and the transfer electrification device cannot uniformly discharge, the density of an image is made uneven. Further, when the separation electrification device cannot uniformly discharge, insufficient separation and retransfer are caused.

As a conventional art for solving the problems described above, there is proposed a system which includes a discharge wire cleaning member having a polishing force, which is sufficient to remove pollutants, such as toner and the like, strongly adhered on the surface of a discharge wire as disclosed in Japanese Patent No. 2,675,837.

There have been tried various kinds of discharge wires to withstand the discharge wire cleaning member having the strong polishing force. For example, in the combination of a tungsten wire as a discharge wire whose surface is plated with gold and a cleaning member having a polishing force capable of removing the pollutants deposited on the surface of the discharge wire, the cleaning member scrapes off even the gold plating on the surface of the discharge wire.

A plating having a thickness of at least about 0.3 $\mu$m is necessary to apply the gold plating uniformly. The chips of the gold plating, which are scraped off by the cleaning member are made to whisker-like chips whose size is as large as 0.1 to 2 mm in cooperation with the ductility of the gold and prevent the uniform discharge of the electrification device by themselves.

There is a system in which a tungsten wire as a discharge wire, whose surface is mirror-finished by electrolytic grinding (herein, the mirror finished tungsten wire is called a white tungsten wire), is combined with a cleaning member having a strong polishing force as another conventional discharge wire.

However, when the white tungsten wire is left as it is in an environment of high temperature and high humidity, the surface thereof is naturally oxidized. Further, since the state of the oxidation lacks uniformity, the uneven naturally-oxidized-state also prevents uniform discharge.

There is also proposed a discharge wire, which is composed of a tungsten wire oxidized by a positive means such as heating or the like as still another conventional discharge wire as disclosed in Japanese Unexamined Patent Application Publication No. 48-74231 and Japanese Unexamined Patent Application Publication No. 8-305135. However, the tungsten wire having been oxidized at a high temperature has an advantage and a disadvantage as described below.

Since the oxidized layer on the surface of the tungsten wire having been oxidized at high temperature (at least 650° C.) is very uniform and hard, it can prevent natural oxidation and at the same time the oxidized layer on the surface cannot be easily scraped off even by a cleaning member having a strong polishing force.

However, it is difficult to apply the strong oxidation processing only to the very thin surface layer of the surface of the discharge wire whose diameter is about 200 $\mu$m at the largest as described above, and, as a result, the oxidized surface of the discharge wire has a thickness of several microns, whereby the discharge wire is liable to be mechanically damaged by bending and the like.

A discharge wire which is mechanically fragile greatly impairs workability in its replacement, and the like, which is, needless to say, a disadvantage. Particularly, in a discharge wire having a diameter of 100 $\mu$m or less, which is excellent in discharge efficiency, it is difficult that a practically usable strength is compatible with strong oxidizing processing.

SUMMARY OF THE INVENTION

An object of the present invention is to provide a discharge wire whose surface is not naturally oxidized unevenly and a method of manufacturing the discharge wire.

Another object of the present invention is to provide a discharge wire having sufficient mechanical characteristics and a method of manufacturing the discharge wire.

Still another object of the present invention is to provide an electrification device having a high wire surface polishing capability.

A further object of the present invention is to provide a method of manufacturing a discharge wire which comprises the steps of:

preparing a tungsten wire;

mirror polishing the surface of the wire; and forming an oxidized layer on the surface of the mirror-polished wire by heating it at a temperature in the range of 400 to 600° C.

A still further object of the present invention is to provide an electrification device which comprises:

a mirror-finished tungsten wire the surface of which has an oxidized layer formed by being heated at a temperature in the range of 400–600° C.

a polishing means for polishing the surface of the wire; and a voltage imposing means for imposing a discharge voltage on the wire.

Further objects of the present invention will become apparent from the following description.

DESCRIPTION OF THE PREFERRED EMBODIMENTS

Embodiments of the present invention will be described below in connection with the accompanying drawings.

Embodiment 1

Figure 5:
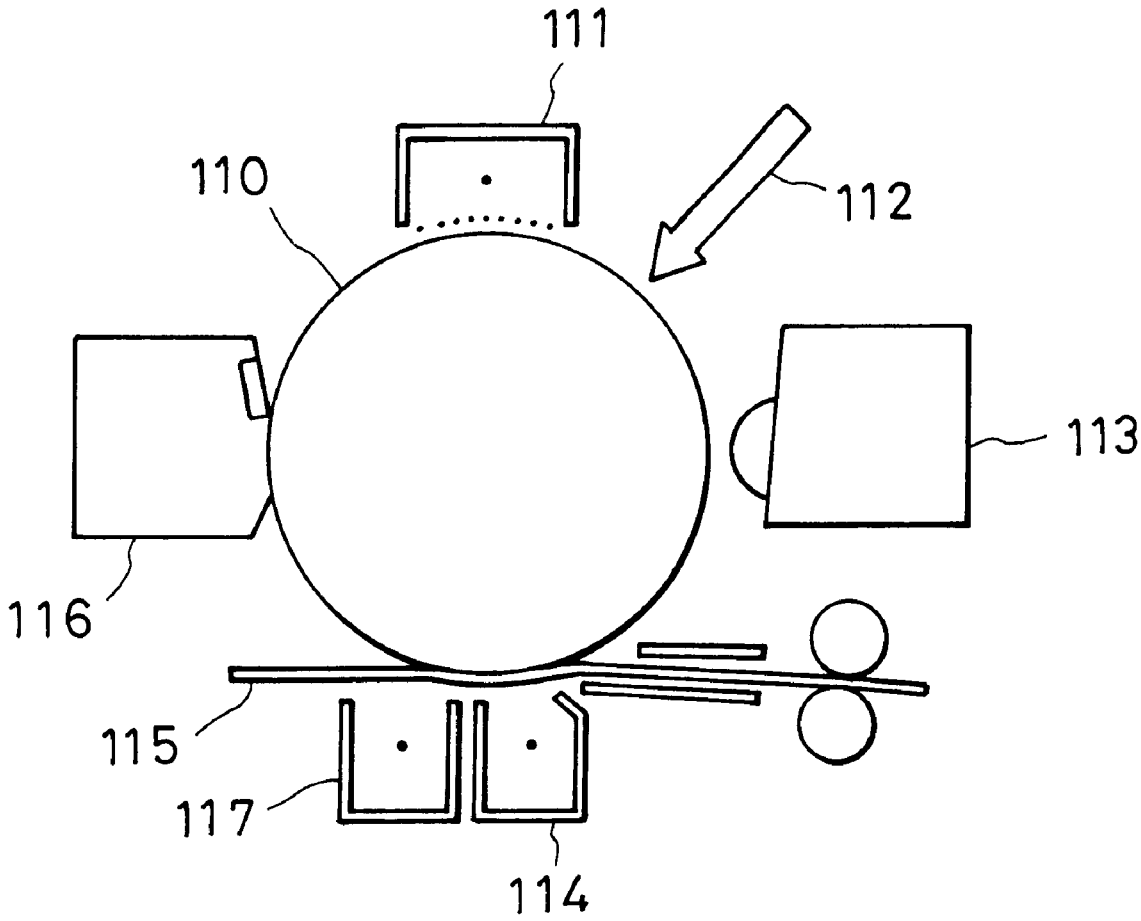
FIG. 5 is a cross sectional view showing the schematic arrangement of an image forming apparatus.
Figure 6:
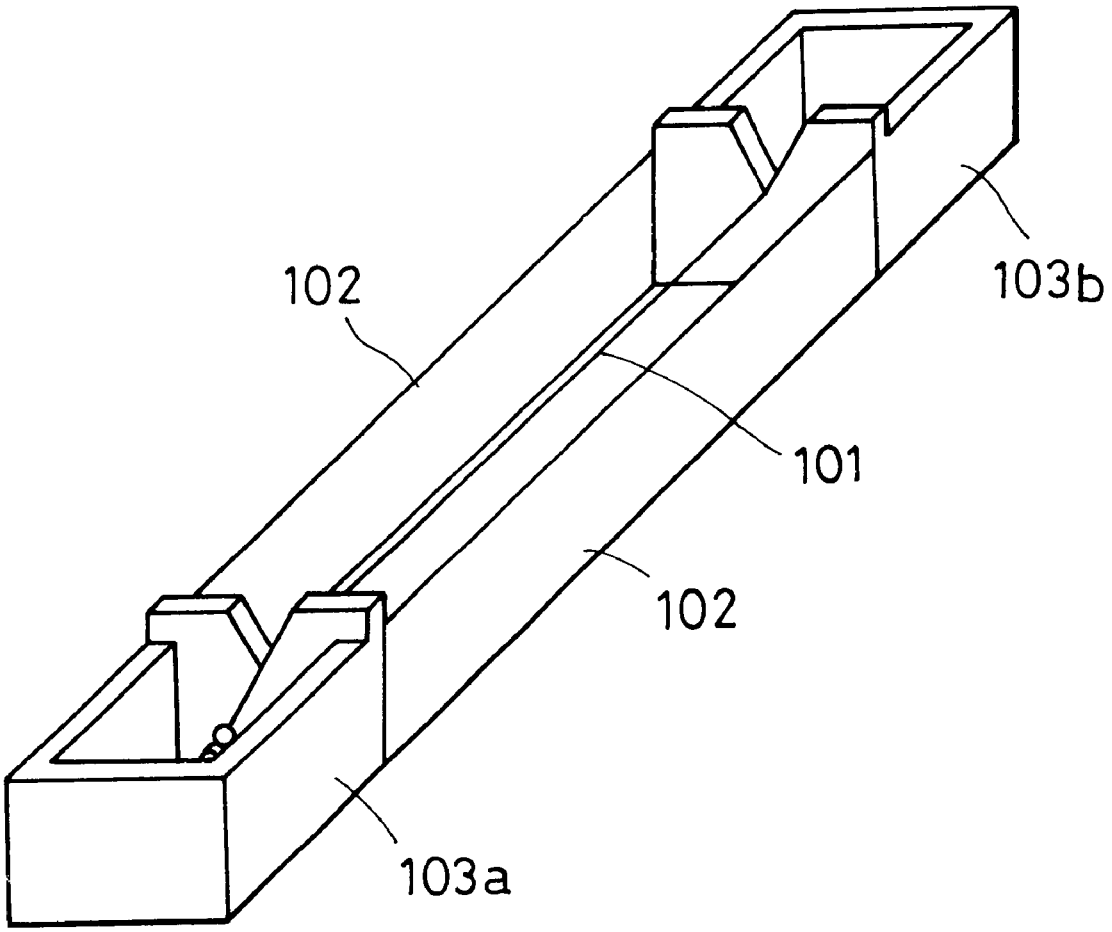
PRIOR ART FIG. 6
FIG. 6 is a view showing an example of a conventional electrification device.

FIG. 5 shows a cross sectional view showing the schematic arrangement of an image forming apparatus in which a discharge wire and an electrification device based on the present invention are preferably used. A surface of an image carrier 110 is uniformly electrified on the surface thereof by a primary electrification device 111 and irradiated with an image exposing light 112 so that an electrostatic latent image is formed on the surface thereof. The electrostatic latent image is developed by a developing unit 113 and made to make a toner image.

In the developing unit 113, a toner carrier (not shown), which carries toner in a predetermined coating thickness, comes into contact with the image carrier 110 while rotating to thereby develop the electrostatic latent image as a toner image. The toner image formed on the surface of the image carrier 110 is transferred onto a member to be transferred 115 as a sheet member, to which an electrical charge having a polarity opposite to that of the toner is applied by a transfer electrification device 114, by electrostatic absorbing force at a transfer position held between the transfer electrification device 114 and the image carrier 110.

The remaining toner, which is not perfectly transferred onto the member to be transferred 115 at the transfer position, is removed from the surface of the image carrier 110 by a cleaner 116, and the image carrier 110 is prepared for the next image formation.

The member to be transferred 115, onto which the toner image has been transferred at the transfer position, is separated from the image carrier 110 in such a manner that the transfer electric charge, which has been applied thereto by the transfer electrification device 114, is partly removed by a separation electrification device 117. A discharge voltage having a polarity opposite to that of the transfer electrification and discharge voltage being an alternating voltage are often used in the separation electrification device 117.

Figure 4:
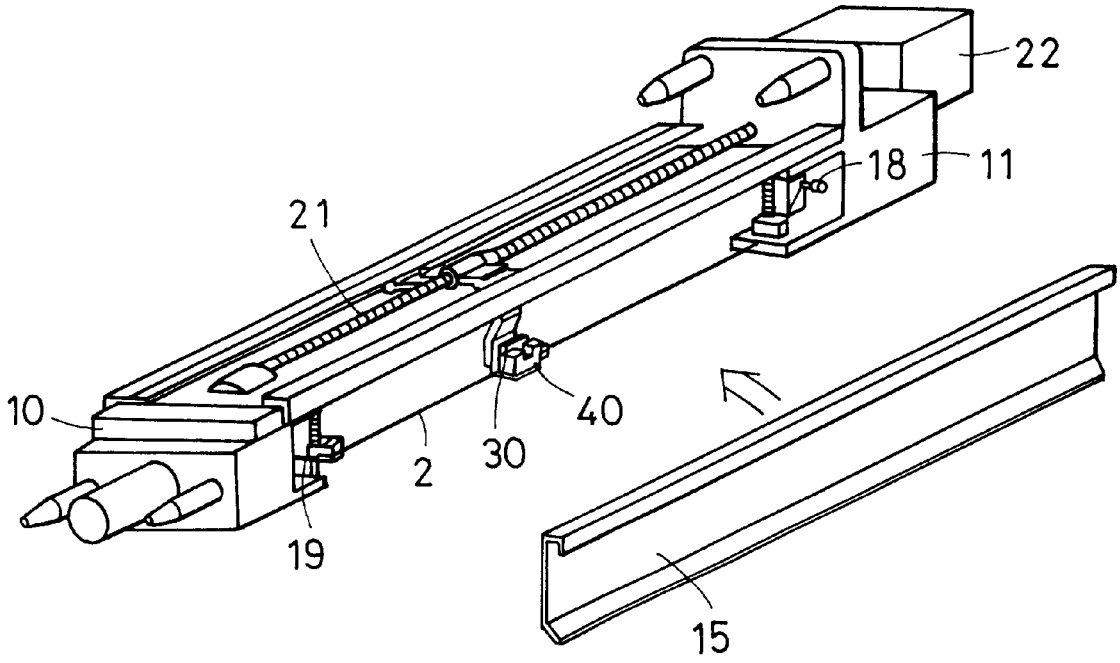
FIG. 4 is a perspective view of an electrification device of the embodiment of the invention.

FIG. 4 is a perspective view of the electrification device of an embodiment of the invention. The electrification device can be used as the primary electrification device of an image forming apparatus as described in the related art, although it is not restricted to such an apparatus.

When the primary electrification device is mounted in the image forming apparatus, the lower portion thereof confronts an image carrier in FIG. 4 so that the image carrier can be uniformly electrified.

In FIG. 4, numeral 2 denotes a discharge wire and numeral 15 denotes a shield plate acting as a confronting electrode as an electrode member. Note that FIG. 4 is a view showing a state in which the detachable shield plate 15 is removed. The discharge wire 2 is stretched by a discharge wire stretch pin 18 and a discharge wire stretch spring 19 with predetermined tensile strength so that it is in parallel with the surface of an image carrier (not shown). A high voltage is imposed on the discharge wire 2 through a high voltage power supply (not shown) and controller (not shown) so that the discharge wire performs corona discharge at predetermined timing while an image being formed.

Numeral 30 denotes a discharge wire cleaning member for polishing and removing pollutants deposited on the surface of the discharge wire 2. The discharge wire cleaning member 30 is supported by a cleaning member support member 40. A cleaning member moving screw 21, which is rotated by a cleaning member drive motor 22, and the cleaning member support member 40 are arranged such that they have a relationship of a male screw and a compatibly-threaded borehole. The rotation of the cleaning member drive motor 22 permits the discharge wire cleaning member 30 to reciprocate between electrification blocks 10 and 11.

The cleaning member drive motor 22 is controlled such that the discharge wire cleaning member 30 makes a reciprocating motion once at predetermined intervals based on the number of times images have been formed by the image forming apparatus. Further, the discharge wire cleaning member 30 and the cleaning member support member 40 are controlled so as to be located in the vicinity of the electrification block 10 or 11 while an image is formed by the image forming apparatus so that they do not prevent uniform electrification of the image carrier.

Figure 1:
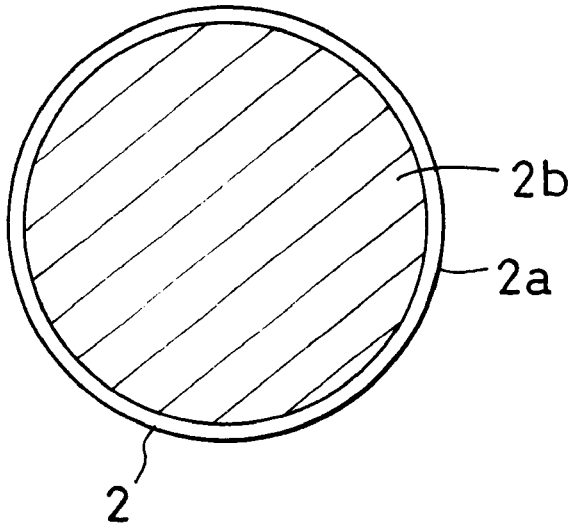
FIG. 1 is a view of a discharge wire having an oxidized layer of an embodiment of the invention.

FIG. 1 shows a sectional view of a discharge wire having an oxidized layer as the discharge wire 2 of the embodiment of the invention. The discharge wire 2 is a tungsten wire having the oxidized layer made by oxidizing only the surface of a white tungsten wire having a diameter of 60 $\mu$m in an atmosphere containing oxygen at 550° C. (which may be in the range of 400 to 600° C.). Numeral 2*a* denotes the oxidized layer composed of tungsten oxide, and numeral 2*b* denotes the base layer of white tungsten.

The thus formed oxidized layer has a thickness of about 0.05 $\mu$m and it is within the range of 0.01 to 0.3 $\mu$m even if the variation of processes is taken into consideration.

While the oxidized layer is a very thin film, since it is uniformly formed on the surface of the white tungsten base layer, the surface is not unevenly oxidized even if it is left in an environment of high temperature and high humidity for a long period of time.

Further, since the oxidized layer is very thin, it does not lower the mechanical strength of the very thin tungsten wire having a diameter of 60 $\mu$m, whereby maintenance such as the replacement of the discharge wire 2, and the like can be easily carried out.

Figure 3:
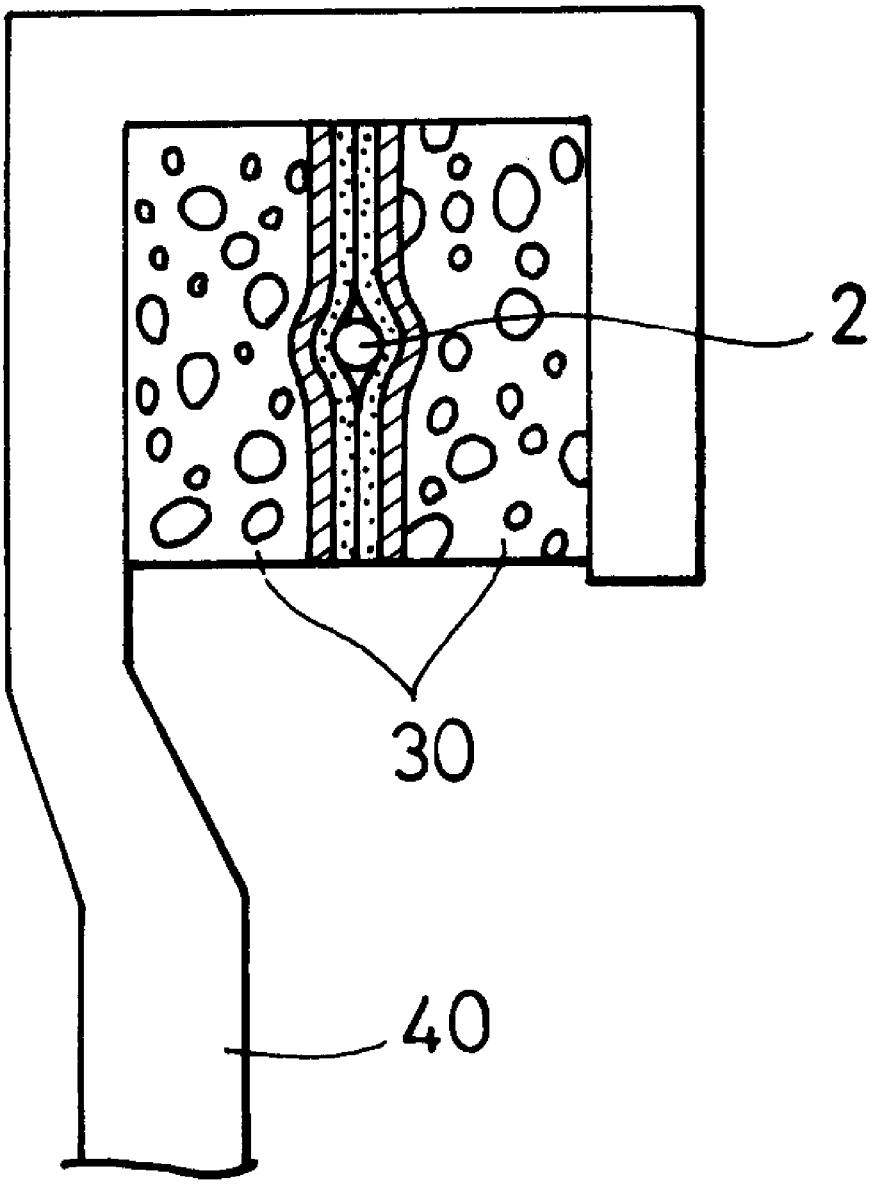
FIG. 3 is an enlarged view showing how a pair of the discharge wire cleaning members attached to a cleaning member support member clamp the discharge wire.

FIG. 3 is an enlarged view showing how the two discharge wire cleaning members 30 mounted on the cleaning member support member 40 clamp the discharge wire 2.

Figure 2:
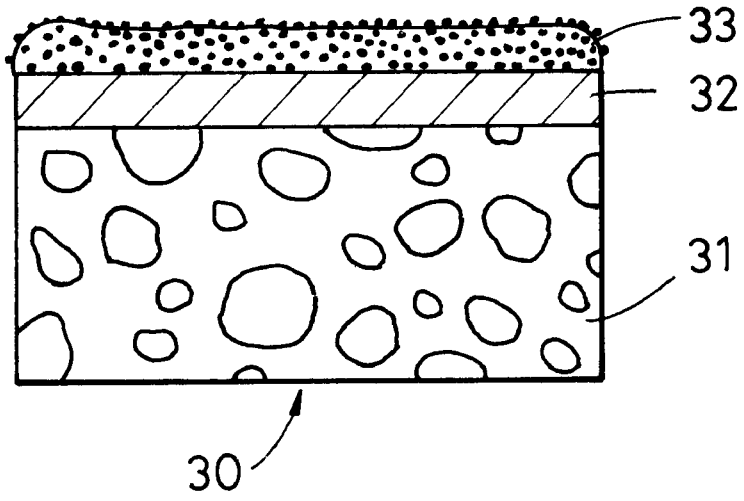
FIG. 2 is an enlarged sectional view of a discharge wire cleaning member.

FIG. 2 is an enlarged view of the discharge wire cleaning member 30. The discharge wire cleaning member 30 is composed of a support layer 31, which is formed of an elastic sponge rubber, a wear resistant layer 32, which is adhered on the support layer 31 through a pressure sensitive adhesive double coated tape and employs a non-woven PET. material, and a polishing layer 33, which is formed of alumina powder hardened with an epoxy resin and deposited on the wear resistant layer 32.

As shown in FIG. 3, the polishing layer 33 is caused to be in contact with the discharge wire 2 under pressure by the elastic force of the support layer 31 and the wear resistant layer 32 so as to wrap the discharge wire 2.

In the embodiment, the oxidized layer on the surface of the discharge wire 2 and the polluted materials on the surface thereof, which have been deposited by the discharge performed in the formation of an image are polished and removed. The discharge wire cleaning member 30 reciprocates between the electrification blocks 10 and 11 in a state that the discharge wire 2 is clamped thereby just after the main switch of the image forming apparatus is turned on and each time after 2000 images have been formed.

The oxidized layer of the present invention can be easily polished and removed with abrasives such as alumina powder at a relatively early time from the beginning of use of the discharge wire 2 because it is formed at a relatively low temperature.

Since the oxidized layer composed of the tungsten oxide is made to powder having a diameter of 0.01 to 0.1 $\mu$m or less after it is polished, different from a metal film such as gold plating, it does not prevent the uniform discharge even if it remains on the surface of the discharge wire 2.

It has been confirmed by the analysis performed by inventors that after almost all the oxidized layer formed at an early time is removed in a thickness direction by the discharge wire cleaning member 30, an oxide film having a thickness in the range of 0.05 to 0.3 $\mu$m steadily exists by the repetition of the formation of a new oxidized layer due to the heat generated when the discharge wire 2 discharges and the polish of it by the discharge wire cleaning member 30.

Only the cylindrical surface layer of the discharge wire 2 is oxidized by the heat generated by the discharge and a very thin oxidized layer is formed because the heat has a very small quantity of energy.

The very thin tungsten oxidized layer formed by the discharge as described above prevents the uneven oxidization of the surface of the discharge wire even if the image forming apparatus is used in a high temperature and high humidity environment for a long period of time or even if it is left therein as it is, whereby uniform discharge characteristics can be obtained at all times.

Embodiment 2

Even if the discharge wire of the present invention is applied to a transfer electrification device, uniform discharge characteristics can be obtained at all times similarly to the Embodiment 1 regardless of the environment in which the discharge wire is preserved or the temperature and humidity at which the discharge wire is used.

Further, even if the discharge wire of the present invention is applied to an electrification device, such as a separation electrification device, which discharges by means of a polarity using an alternating current by an imposed bias containing an alternating voltage, stable discharge characteristics can be obtained at all times, so that the present invention exhibits a remarkable effect on the insufficient separation of a material to be transferred and the prevention of retransfer.

In particular, in the electrification device, which discharges by means of the polarity using the alternating current, the present invention has a significant effect because the surface of the discharge wire is polluted at a high speed.

Embodiment 3

The discharge wire used in the present invention is characterized in that it is polished by the polishing force of the discharge wire cleaning member 30. However, it is very important that the oxidized layer is very thin and uniform to exhibit the most out of the characteristic for preventing uneven and natural oxidation of the discharge wire which is liable to be caused when it is left as it is in a high temperature and high humidity environment, the. mechanical strength characteristic for permitting a job for replacing the discharge wire, and the like, to be performed easily, the uniform discharge characteristics while the discharge wire is used as a part of the electrification device, and the like.

Further, it is preferable that the oxidized layer is thin in order that the chips of the oxidized layer, which are produced when the discharge wire is polished by the discharge wire cleaning member, do not prevent a uniform discharge.

In particular, in the discharge wire having a diameter of about 100 $\mu$m, it is preferable that the oxidized layer has a thickness of about 0.1 $\mu$m. Further, in the discharge wire having a diameter of about 70 $\mu$m or less, it is most preferable that the oxidized layer has a thickness of about 0.05 $\mu$m.

It is important that the period of time during which the discharge wire is heated in air is limited to 10 seconds or less in order to uniformly form a very thin oxidized layer.

In particular, in the discharge wire having a diameter of about 100 $\mu$m, it is preferable that to set the heating time to 5 seconds or less. Further, in the discharge wire having a diameter of about 70 $\mu$m or less, it is most preferable to set the heating time to 2 seconds or less.

Note that it is effective to energize the discharge wire and heat it by a current making use of the characteristics of tungsten as a conductive member in order to heat the discharge wire in a short time.

Therefore, in order to reproduce an oxidized layer scraped by the polishing carried out by the discharge wire cleaning member 30, it is also preferable to provide an energizing means for energizing the discharge wire and heating it with the electrification device or the image forming apparatus itself so that the discharge wire is periodically energized and an oxidized layer is reproduced.

According to the present invention described above, uniform and stable electrification can be carried out making use of the discharge wire having the thin oxidized layer formed on the surface thereof because the surface is not naturally oxidized unevenly even if the discharge wire is left as it is in a high temperature and high humidity environment.

Further, the discharge wire has sufficient mechanical characteristics, resists the deterioration of its quality such as bending and the like, and enhanced workability when the discharge wire is replaced.

In the combination of the discharge wire with the cleaning means, the pollutants deposited on the surface of the discharge wire and the oxidized layer thereon are simultaneously polished and removed by the cleaning performed periodically by the cleaning means, whereby the surface of the discharge wire can always be kept in a clean state and the discharge wire can uniformly and stably discharge. The chips made by the cleaning are difficult to be made into a whisker-like shape because they are composed of pollutants and the oxidized layer formed on the surface of the discharge wire, and thus they do not prevent a uniform discharge.

The application of the present invention to various kinds of the electrification devices in the image forming apparatus results in the following advantages. When the present invention is applied to the primary electrification device for electrifying an image carrier and to the transfer electrification device for imposing a transfer electric potential on a sheet member, an image of high quality, in which uneven density is suppressed, can be always obtained regardless of the environment in which the devices are used.

When the present invention is applied to the separation electrification device for imposing a separation electric potential on a sheet member, an excellent sheet separating capability can be obtained regardless of the environment in which the device is used.

Further, since the life of the discharge wires of the respective devices can be dramatically improved by the present invention and the frequency of replacement of the discharge wire can be greatly reduced, not only the maintenance efforts of the image forming apparatus can be greatly reduced but also the downtime of the apparatus can be shortened.

While the embodiments of the present invention have been described above, the present invention is be no means limited to the above-described embodiments and any modification can be applied thereto so long as it is within the spirit of the claimed invention.

What is claimed is:

1. A method of manufacturing a discharge wire comprising the steps of:

preparing a tungsten wire;

mirror polishing a surface of the wire; and forming an oxidized layer on the surface of the mirror-polished wire by heating the mirror-polished wire at a temperature in a range of 400° to 600° C., wherein a thickness of the oxidized layer is in the range of 0.01 to 0.3 $\mu$m.

2. A method of manufacturing a discharge wire according to claim 1, wherein a temperature for heating the mirror-polished wire for forming the oxide layer is lower than a surface temperature of the mirror-polished wire while the mirror-polished wire discharges.

3. A method of manufacturing a discharge wire according to claim 1, wherein a heating time for forming the oxidized layer is 10 seconds or less.

4. A method of manufacturing a discharge wire comprising the steps of:

preparing a tungsten wire;

mirror polishing a surface of the wire; and forming an oxidized layer on the surface of the mirror-polished wire by heating the mirror-polished wire at a temperature in a range of 400°to 600° C., wherein a heating time for forming the oxidized layer is 10 seconds or less.

5. A method of manufacturing a discharge wire according to claim 4, wherein a temperature for heating the mirror-polished wire for forming the oxide layer is lower than a surface temperature of the mirror-polished wire while the mirror-polished wire discharges.

6. A method of manufacturing a discharge wire according to claim 4, wherein a thickness of the oxidized layer is in a range of 0.01 to 0.3 $\mu$m.

* * * * *

UNITED STATES PATENT AND TRADEMARK OFFICE

CERTIFICATE OF CORRECTION

PATENT NO. : 6,605,165 B2 
DATED : August 12, 2003
INVENTOR(S) : Tsuyoshi Kunishi et al.

It is certified that error appears in the above-identified patent and that said Letters Patent is hereby corrected as shown below:

Title page,
Item [57], ABSTRACT,
Line 5, "range" should read -- range of --.
Item [56], Foreign Patent Documents,

| | | | |
|---|---|---|---|
| "358029522 | 2/1983" should read -- | 58-29522 | 2/1983 --; |
| "61135445 | 6/1986" should read -- | 61-135445 | 6/1986 --; and |
| "40249086 | 9/1996" should read -- | 4-249086 | 9/1992 --. |

Column 3,
Line 32, "cross sectional" should read -- cross-sectional --; and
Line 44, "cross sectional" should read -- cross-sectional --.

Column 6,
Line 27, "the." should read -- the --.

Column 7,
Line 38, "be" should read -- by --.

Signed and Sealed this

Eleventh Day of May, 2004

JON W. DUDAS
*Acting Director of the United States Patent and Trademark Office*